United States Patent [19]

Lagos

[11] 4,020,385

[45] Apr. 26, 1977

[54] FLUORESCENT LAMP HAVING CONDUCTIVE FILM AND PROTECTIVE FILM THEREFOR

[75] Inventor: Costas C. Lagos, Danvers, Mass.

[73] Assignee: GTE Sylvania Incorporated, Danvers, Mass.

[22] Filed: Aug. 9, 1976

[21] Appl. No.: 713,088

[52] U.S. Cl. ..... 313/489; 313/221; 313/492; 313/493

[51] Int. Cl.[2] ..... H01J 61/35; H01J 61/44

[58] Field of Search ..... 313/489, 492, 493, 220, 313/221

[56] References Cited

UNITED STATES PATENTS

| | | | |
|---|---|---|---|
| 3,624,444 | 11/1971 | Berthold et al. | 313/489 X |
| 3,875,455 | 4/1975 | Kaduk et al. | 313/489 |

*Primary Examiner*—Palmer C. Demeo

*Attorney, Agent, or Firm*—James Theodosopoulos

[57] ABSTRACT

A fluorescent lamp has an electroconductive tin oxide transparent film on the inner surface of the lamp envelope and a protective coating of magnesium fluoride-titania thereover.

2 Claims, No Drawings

FLUORESCENT LAMP HAVING CONDUCTIVE FILM AND PROTECTIVE FILM THEREFOR

THE INVENTION

This invention relates to fluorescent lamps. Such lamps have a glass envelope, a phosphor coating on the inner surface, electrodes at each end, and a fill of low pressure mercury vapor and starting gas, generally argon.

Recently, krypton has become increasingly used in fluorescent lamps, for energy saving purposes. With krypton, a starting aid is usually needed for lamp ignition because krypton, unlike argon, does not form a Penning mixture with mercury vapor. A commonly used starting aid is a transparent electroconductive film of tin oxide applied to the inner envelope surface by, for example, the method shown in U.S. Pat. No. 2,506,346.

Unless the tin oxide has a protective coating thereover, it will darken after a few hours of lamp operation, thereby undesirably decreasing light output. Generally disclosed protective films for tin oxide are oxide films, as shown in U.S. Pat. No. 3,624,444.

This invention discloses another protective film for tin oxide that has generally better adhesion than prior art protective films for tin oxide. The protective film in accordance with this invention is made of magnesium fluoride and titanium dioxide. Although it is known that such a film is a glass lubricant, the prior art does not suggest that it can inhibit discoloration of an electroconductive tin oxide film.

The $MgF_2$-$TiO_2$ film does not protect the tin oxide conductive film by merely covering and shielding it from the arc discharge. Instead, the $MgF_2$-$TiO_2$ film appears to react with the internal conductive film in such a way that the conductive film is somehow stabilized and does not deteriorate so readily when exposed to the lamp arc. This is supported by the fact that resistance meter surface-contact probes can still measure the resistance of the conductive film after the $MgF_2$-$TiO_2$ film has been applied over the conductive film.

The improved lamp life effect is only accomplished if all ingredients, that is, magnesium fluoride, titanium dioxide and tin oxide, are present. If $MgF_2$ is not used, and only $TiO_2$ and tin oxide are present, the beneficial maintenance effect is reduced; see Table I. In the tables, the lamps were all 48 inch 40 watt lamps, and the control lamps had no conductive or protective films.

TABLE I

| | 0 hours | 100 hours | 100 hour maintenance |
|---|---|---|---|
| | lumens | lumens | |
| Control lamps. | 3229 | 3170 | 98.2% |
| Conductive film (C.F.) only. | 3177 | 3052 | 96.1 |
| C.F. + $TiO_2$ only. | 3194 | 3087 | 96.6 |
| C.F. + $MgF_2$-$TiO_2$. | 3179 | 3090 | 97.2 |

There is no beneficial effect if only the $MgF_2$-$TiO_2$ coating is applied to the bulb with no tin oxide conductive film present; see Table II.

TABLE II

| | 0 hours | 100 hours | 100 hour maintenance |
|---|---|---|---|
| | lumens | lumens | |
| Conductive film (C.F.) only. | 3173 | 3064 | 96.6% |
| $MgF_2$-$TiO_2$ only. | 3196 | 3066 | 95.9 |
| C.F. + $MgF_2$-$TiO_2$ | 3240 | 3160 | 97.5 |

A film of tin oxide alone gives the largest deterioration in lamp lumens as a function of lamp burning time; see Table III.

TABLE III

| | 0 hours | 100 hours | 1000 hours | 2000 hours | maintenance |
|---|---|---|---|---|---|
| | lumens | lumens | lumens | lumens | |
| Control lamps. | 3284 | 3212 | 3052 | 3032 | 92.3% |
| C.F. only. | 3238 | 3073 | 2786 | 2691 | 83.1 |
| C.F. + $MgF_2$-$TiO_2$ | 3224 | 3152 | 2906 | 2866 | 88.9 |

The amount of the $MgF_2$-$TiO_2$ film that is applied should be only enough to give the desired protection. This amount is determined experimentally and is a function of spray time, spraygun pressure, type of nozzle, etc. If too much of the $MgF_2$-$TiO_2$ film is applied, there is a decrease in film light transmission caused by a darkening of the film which is the result of the overreaction of the $MgF_2$-$TiO_2$ with the tin oxide conductive film.

The amount or thickness of the tin oxide film on the bulb should be such as to give a bulb end-to-end resistance of from 5 to 50 kilohms for a 48 inch bulb. Resistances less than 5 kilohms give poorer transmission with subsequent loss in lamp lumens, while resistance greater than 50 kilohms are not conductive enough to function as a starting aid for the lamp.

In a specific example, a fluorescent lamp glass bulb is placed on heated rotating steel rolls at 550° C and after heating for about 5 minutes is internally coated with a tin oxide conductive film by spraying the hot bulb with a solution consisting of 50 ml methanol, 10 ml anhydrous $SnCl_4$ and 1 gm ammonium bifluoride. After removing the bulb from the rolls and allowing it to cool, the resistance of the conductive film is measured. The end-to-end resistance should be between 5 and 50 kilohms.

The bulb is then placed back on the heated rolls and again heated to 550° C. This time the $MgF_2$-$TiO_2$ solution is sprayed into the hot bulb. The solution is composed of 125 ml butyl acetate, 125 ml naphtha, 30 ml tetrabutyl titanate and 1.5 gm $MgF_2$. This solution is sprayed into the hot bulb until just before a very slight darkening of the film begins to occur, usually 2 to 4 seconds. The heat causes decomposition of the tetrabutyl titanate resulting in a film containing $TiO_2$ and $MgF_2$.

Next, the bulb is coated with phosphor and manufactured into a fluorescent lamp. The gas fill in the test lamps was argon and a starting aid was not necessary, but the resistances of the tin oxide film were measured during the various tests and during the various stages of lamp processing so that they would be of sufficient thickness and conductivity to start a krypton gas-filled fluorescent lamp.

The temperature of the hot glass bulb should be at least 500° C before the tin oxide conductive film and the $MgF_2$-$TiO_2$ solutions are applied, with 550° C being preferred. At temperatures below 500° C the conductive film is not as stable to subsequent lamp processing and the lamp operation and the $MgF_2$-$TiO_2$ film does not form as well or react as well with the tin oxide film as it does at temperatures above 500° C. The upper temperature limit for both film applications is the melting point of the glass.

In summation, the use of a $MgF_2$-$TiO_2$ protective film over a tin oxide conductive film on the interior surface of a fluorescent lamp results in a substantially improved tin oxide film containing lamp. Without the $MgF_2$-$TiO_2$ film the maintenance and subsequently the light output of a tin oxide film coated fluorescent lamp would be greatly reduced and impractical for commercial use.

I claim:

1. In a fluorescent lamp having a glass envelope, electrodes at each end thereof, a fill of starting gas and low pressure mercury vapor, and a transparent electroconductive tin oxide film on the inner surface of the envelope with a phosphor coating thereover, the improvement which comprises a protective film of magnesium fluoride-titanium dioxide directly on the tin oxide film.

2. The lamp of claim 1 wherein the characteristic of the magnesium fluoride-titanium dioxide film is such that the resistance of the tin oxide film can be measured by means of surface-contact probes pressed against the magnesium fluoride-titanium dioxide film.

* * * * *